US005554004A

United States Patent [19]

Stewart

[11] Patent Number: 5,554,004

[45] Date of Patent: Sep. 10, 1996

[54] FAN IMPELLER ASSEMBLY

[75] Inventor: Timothy J. Stewart, Akron, Ohio

[73] Assignee: Ametek, Inc., Kent, Ohio

[21] Appl. No.: 508,226

[22] Filed: Jul. 27, 1995

[51] Int. Cl.[6] ..... F04D 29/28

[52] U.S. Cl. ..... 416/185; 416/241 A

[58] Field of Search ..... 416/185, 241 A, 416/239; 29/889.4

[56] References Cited

U.S. PATENT DOCUMENTS

| | | | |
|---|---|---|---|
| 3,095,822 | 7/1963 | Kiefer | 416/185 X |
| 3,521,973 | 7/1970 | Schouw | 416/185 |

FOREIGN PATENT DOCUMENTS

| | | | |
|---|---|---|---|
| 2556824 | 6/1977 | Germany | 416/185 |
| 55-88941 | 7/1980 | Japan | 29/889.4 X |
| 1515296 | 6/1978 | United Kingdom | 416/185 |

*Primary Examiner*—Edward K. Look
*Assistant Examiner*—Michael S. Lee
*Attorney, Agent, or Firm*—Renner, Kenner, Greive, Bobak, Taylor & Weber

[57] ABSTRACT

A molded impeller fan assembly has a backing plate and a plurality of blades extending generally orthogonally upwardly therefrom. A V-shaped buttress is formed at the transition of each blade to the backing plate. Each buttress is defined by a pair of opposed walls which are formed where the backing plate curves gradually upward toward the blade apex. A V-shaped indentation is disposed between the walls in a side of the backing plate opposite the blades. The walls of the buttress serve to transfer centrifugal and impact forces from the blades to the backing plate.

4 Claims, 1 Drawing Sheet

FAN IMPELLER ASSEMBLY

TECHNICAL FIELD

The invention herein resides in the art of impeller fans. More particularly, the invention relates to such fans which are molded from plastic materials. Specifically, the invention relates to the construction of the transition between the fan blades and the backing plate in an impeller fan.

BACKGROUND ART

Previously, it was known to manufacture rotating impeller fans from various metal materials. Such manufacturing processes often involved molding or machining fans from solid pieces of metal, or stamping individual components such as blades and backing plates from sheet metal and assembling the components together. As is apparent, such techniques require relatively expensive materials and are rather labor intensive.

Recently, it has been known to manufacture rotating impeller fans from a variety of plastic materials. Typically, such impeller fans are injection molded as a single unit. Known impeller fans typically comprise an annular base or backing plate with a plurality of blade members extending orthogonally upward therefrom and radiating outwardly from the center of the base. In typical prior art fans the transition where the blade meets the base comprises a solid blade member extending upwardly at a generally right angle to a continuous base plate.

The drawbacks to such known plastic impellets include their increased vulnerability to stress as a result of centrifugal forces and also to impact of foreign objects. Further, users have demanded that such plastic impellets be stronger, lighter and less expensive than prior designs. Unfortunately, the stronger and lighter weight materials are frequently much more expensive than the commonly used materials.

Thus, there is clearly a need in the art for an improved impeller design which will increase strength and reduce weight while using minimal amounts of conventional materials.

DISCLOSURE OF INVENTION

In light of the foregoing, it is a first aspect of the invention to provide an impeller fan assembly which has increased strength for impact of foreign objects and centrifugal forces, while using conventional plastic materials.

Another aspect of the invention is the provision of an impeller fan assembly which uses less material than previously known designs, resulting in an impeller fan which is both lighter in weight and less expensive.

A further aspect of the invention is the provision of an impeller fan assembly design which optimizes material flow conditions within the mold.

Yet another aspect of the invention is the provision of an impeller fan assembly which is capable of being inexpensively manufactured using known manufacturing techniques and equipment.

The foregoing and other aspects of the invention which will become apparent as the detailed description proceeds are achieved by an improved molded impeller fan assembly having an annular disk shaped backing plate portion and a plurality of blade portions extending generally orthogonally upwardly from a first side of the backing plate portion, the improvement comprising; a transitional portion between the backing plate portion and each of the blade portions; and a V-shaped buttress at said transitional portion, supporting the blade portions relative to the backing plate portion.

Other aspects of the invention are attained by an improvement in a molded impeller an assembly having an annular disk-shaped backing plate portion, and a plurality of blade portions extending generally orthogonally upwardly from a first side of the backing plate portion, the improvement comprising: a transitional portion between the backing plate portion and each of the blade portions; and a V-shaped buttress, at said transitional portion, supporting the blade portions relative to the backing plate portion, said V-shaped buttress comprising: a pair of opposed walls extending obliquely between the backing plate portion and the blade portions, said walls being formed as the backing plate portion curves gradually longitudinally upward toward an apex of each blade portion, and a V-shaped indentation disposed between said opposed walls in a second side of the backing plate portion opposite the blade portions, and directly below said apex; whereby said walls of said buttress serve to support the blade portions and to transfer centrifugal and impact forces from the blade portions to the backing plate portion.

Further aspects of the invention are achieved by an impeller fan comprising: an annular disk-shaped backing plate portion, having a first side and a second side; a plurality of blade portions extending generally orthogonally upwardly from said first side of said backing plate portion, each of said plurality of blade portions having an apex; a transitional portion between said backing plate portion and each of said plurality of blade portions; and a V-shaped buttress, at said transitional portion supporting each of said plurality of blade portions relative to said backing plate portion, said V-shaped buttress comprising, a pair of opposed walls extending obliquely between said backing plate portion and each of said plurality of blade portions, said walls being formed as said backing plate portion curves gradually longitudinally upward toward said apex, and a V-shaped indentation in said backing plate portion between said opposed walls in said second side of said backing plate portion opposite each of said plurality of blade portions and directly below said apex; whereby said walls of said buttress serve to support each of said blade portions, and to transfer centrifugal and impact forces from said plurality of blade portions to said backing plate portion.

BRIEF DESCRIPTION OF DRAWINGS

For a complete understanding of the objects, techniques and structure of the invention, reference should be made to the following detailed description and accompanying drawings wherein.

BEST MODE FOR CARRYING OUT THE INVENTION

Figure 1:
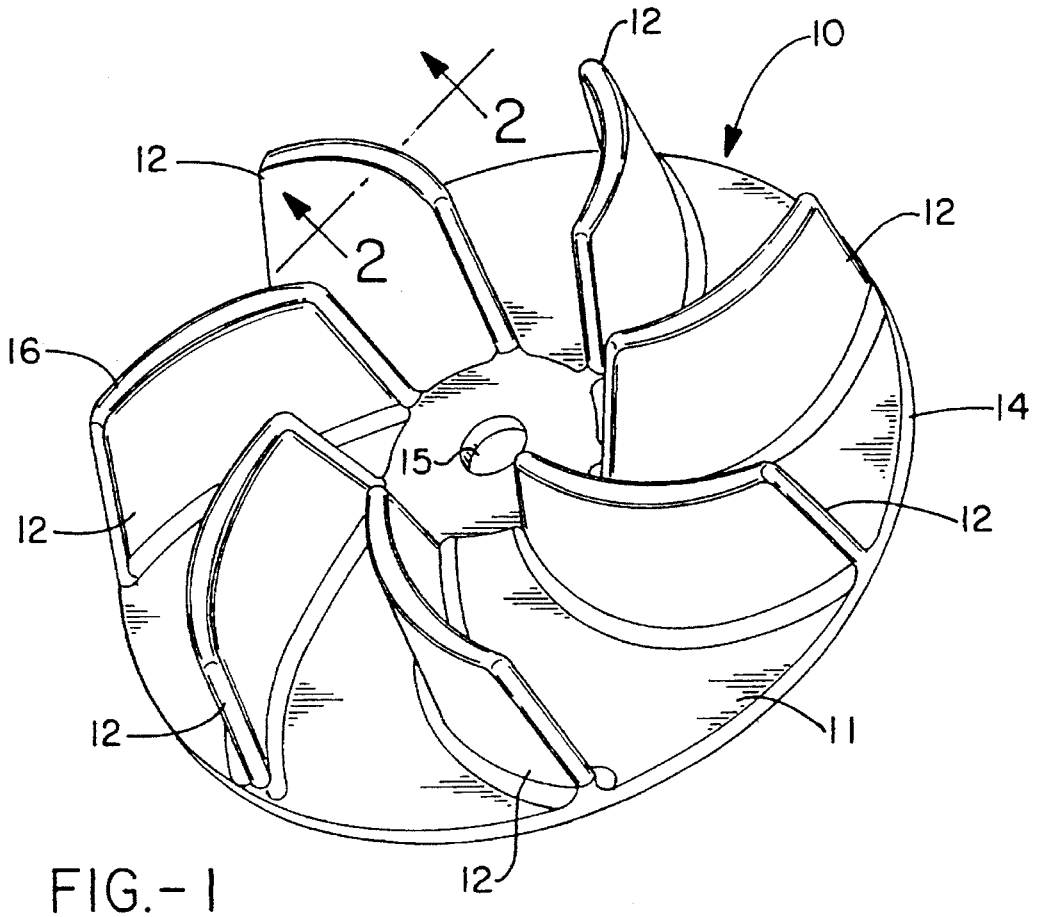
FIG. 1 is a perspective view of an impeller fan according to the invention.

Referring now to the drawings and more particularly to FIG. 1, it can be seen that an impeller fan according to the invention is designated generally by the numeral 10. As shown, the fan 10 is comprised generally of a backing plate portion 11 and a plurality of blade portions 12. The backing plate portion 11 is of a generally annular disk-shaped configuration having a circular outer periphery 14 and a central shaft receiving aperture 15.

The blade portions 12 radiate outwardly from the center of the backing plate portion 11 to the outer periphery 14 thereof. Further, the blade portions 12 extend generally orthogonally upwardly from the backing plate portion 11.

Figure 2:
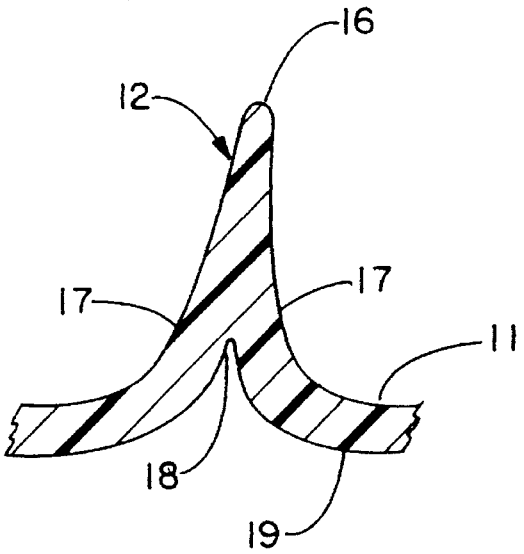
FIG. 2 is a cross-sectional view of a blade portion taken along the line 2—2 of FIG. 1.

With reference now to FIG. 2 the unique cross-sectional configuration of the transition of a blade portion 12 to the backing plate portion 11 is shown. As shown, each blade portion 12 is formed as the relatively horizontal backing plate portion 11 curves gradually longitudinally upward, to a blade apex 16. Due to the inherent thickness of the backing plate portion 11, a pair of opposed walls 17, having a V-shaped indentation 18 therebetween, are formed. The V-shaped indentation 18 is on the lower side 19 of the backing plate portion 11 directly below the blade apex 16. Structurally, the walls 17 and V-shaped indentation 18 serve as a buttress for the blade portions 12. Specifically, the cross-sectional structure serves to facilitate the transfer of centrifugal and impact stresses to the backing plate portion 11 from the blade portions 12 by way of the walls 17. Further, a greater degree of flexibility is achieved in the backing plate portion 11 due to the V-buttress configuration. Those skilled in the art will further recognize that the V-buttress cross-section allows for optimal material flow conditions inside the mold, thereby maximizing material strength. It should also be apparent that the amount of material required is significantly reduced relative to other known configurations, resulting in an impeller fan which is lighter in weight and less expensive to produce.

It should be noted that the impeller fan 10 according to the invention may be utilized in any of the applications which previously allowed the use of molded fan assemblies. That is, the impeller fan 10 may be mounted in the same way as prior art fans, and is operationally equivalent or superior thereto.

Thus, it can be seen that the objects of the invention have been satisfied by the structure presented hereinabove. While in accordance with the patent statutes only the best mode and preferred embodiment of the invention has been presented and described in detail, it is to be understood that the invention is not limited thereto or thereby. Accordingly, for an appreciation of the true scope and breadth of the invention reference should be made to the following claims.

What is claimed is:

1. In a molded impeller fan assembly having an annular disk-shaped backing plate portion, and a plurality of blade portions extending generally orthogonally upwardly from a first side of the backing plate portion, the improvement comprising:

a transitional portion between the backing plate portion and each of the blade portions;

a V-shaped buttress at said transitional portion, said V-shaped buttress supporting the blade portions relative to the backing plate portion; and wherein said V-shaped buttress comprises a pair of opposed walls extending obliquely between the backing plate portion and the blade portion and a V-shaped indentation disposed between said opposed walls, said walls serving to support the blade portion and to transfer centrifugal and impact forces from the blade portions to the backing plate portion, said walls being formed as the backing plate portion curves gradually toward an apex of each blade portion and axially away from the backing plate portion.

2. The improvement in a molded impeller fan assembly as recited in claim 1, wherein said V-shaped indentation is in a second side of the backing plate portion opposite each of the blade portions and directly below said apex.

3. In a molded impeller an assembly having an annular disk-shaped backing plate portion, and a plurality of blade portions extending generally orthogonally upwardly from a first side of the backing plate portion, the improvement comprising:

a transitional portion between the backing plate portion and each of the blade portions; and a V-shaped buttress, at said transitional portion, supporting the blade portions relative to the backing plate portion, said V-shaped buttress comprising: a pair of opposed walls extending obliquely between the backing plate portion and the blade portions, said walls being formed as the backing plate portion curves gradually toward an apex of each blade portion and axially away from the backing plate portion, and a V-shaped indentation disposed between said opposed walls in a second side of the backing plate portion opposite the blade portions, and directly below said apex;

whereby said walls of said buttress serve to support the blade portions and to transfer centrifugal and impact forces from the blade portions to the backing plate portion.

4. An impeller fan comprising:

an annular disk-shaped backing plate portion, having a first side and a second side;

a plurality of blade portions extending generally orthogonally upwardly from said first side of said backing plate portion, each of said plurality of blade portions having an apex;

a transitional portion between said backing plate portion and each of said plurality of blade portions; and, a V-shaped buttress, at said transitional portion supporting each of said plurality of blade portions relative to said backing plate portion, said V-shaped buttress comprising, a pair of opposed walls extending obliquely between said backing plate portion and each of said plurality of blade portions, said walls being formed as said backing plate portion curves toward said apex and axially away from said backing plate portion, and a V-shaped indentation in said backing plate portion between said opposed walls in said second side of said backing plate portion opposite each of said plurality of blade portions and directly below said apex;

whereby said walls of said buttress serve to support each of said blade portions, and to transfer centrifugal and impact forces from said plurality of blade portions to said backing plate portion.

* * * * *